United States Patent [19]

Woolworth

[11] 4,060,865

[45] Dec. 6, 1977

[54] BOAT CONSTRUCTION INCORPORATING FLOTATION MEANS

[75] Inventor: Richard G. Woolworth, Lancaster, Pa.

[73] Assignee: Woodstream Corporation, Lititz, Pa.

[21] Appl. No.: 718,322

[22] Filed: Aug. 27, 1976

Related U.S. Application Data

[63] Continuation-in-part of Ser. No. 682,636, May 3, 1976.

[51] Int. Cl.[2] ..... B63B 3/09

[52] U.S. Cl. ..... 9/6 M; 114/88; 114/123

[58] Field of Search ..... 114/88, 123; 9/6 R, 9/6 M, 6 P, 6 W; 52/578, 716; 248/345.1

[56] References Cited

U.S. PATENT DOCUMENTS

| | | | |
|---|---|---|---|
| 1,032,827 | 7/1912 | Hamilton | 9/6 R |
| 1,335,072 | 3/1920 | Nichols | 9/6 M |
| 1,679,630 | 8/1928 | Roys | 9/6 M |
| 1,723,307 | 8/1929 | Side | 114/88 |
| 1,889,368 | 11/1932 | Messenger | 9/6 M |
| 3,315,284 | 4/1967 | Ludlow | 9/6 P |
| 3,831,212 | 8/1974 | Moore et al. | 9/6 R |

FOREIGN PATENT DOCUMENTS

| | | | |
|---|---|---|---|
| 1,341,497 | 9/1963 | France | 9/6 M |
| 2,223,056 | 2/1973 | Germany | 9/6 P |

*Primary Examiner*—Trygve M. Blix
*Assistant Examiner*—Gregory W. O'Connor
*Attorney, Agent, or Firm*—Holman & Stern

[57] ABSTRACT

A small boat or the like comprising a flotation chamber defined at its gunwale by a first member, preferably integral with the sides of the hull extending upwardly and defining an upper end portion which may include a reverted first member lip, a second member or cover secured at its bottom portion to the hull, the major portion of which is spaced laterally from the first member with its upper end portion extending over the first member and including a reverted second member lip, and a connecting device resiliently engaging the upper end portion or first member lip with the second member lip to secure a flotation material in the form of a block of expanded polystyrene or the like within the flotation chamber. The connecting device can be a separate element pressing the lip of the first and second members against each other or can be a resilient portion of one of the members normally biasing the two members into engagement. A rub rail is defined at the upper end of the flotation chamber and can be formed either by a separate connecting member or by a portion of one of the other members.

5 Claims, 9 Drawing Figures

FIG. 1
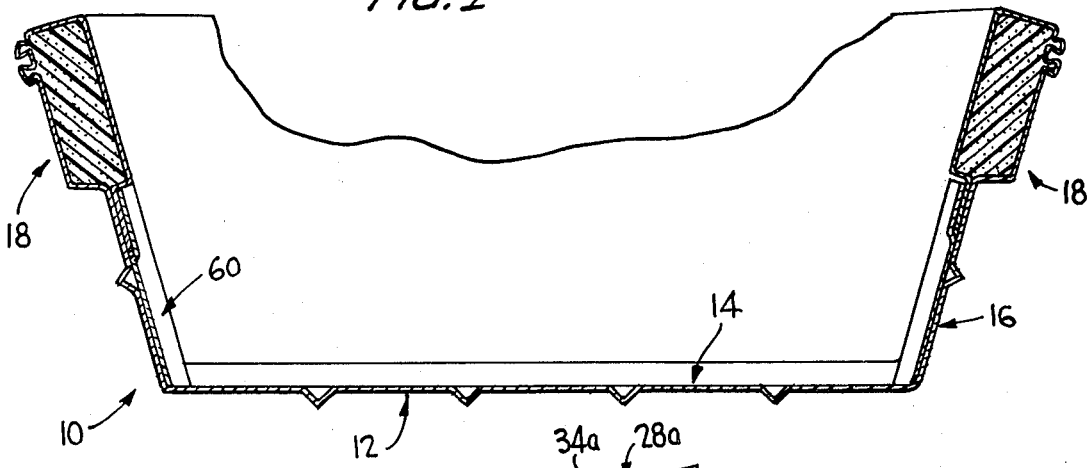
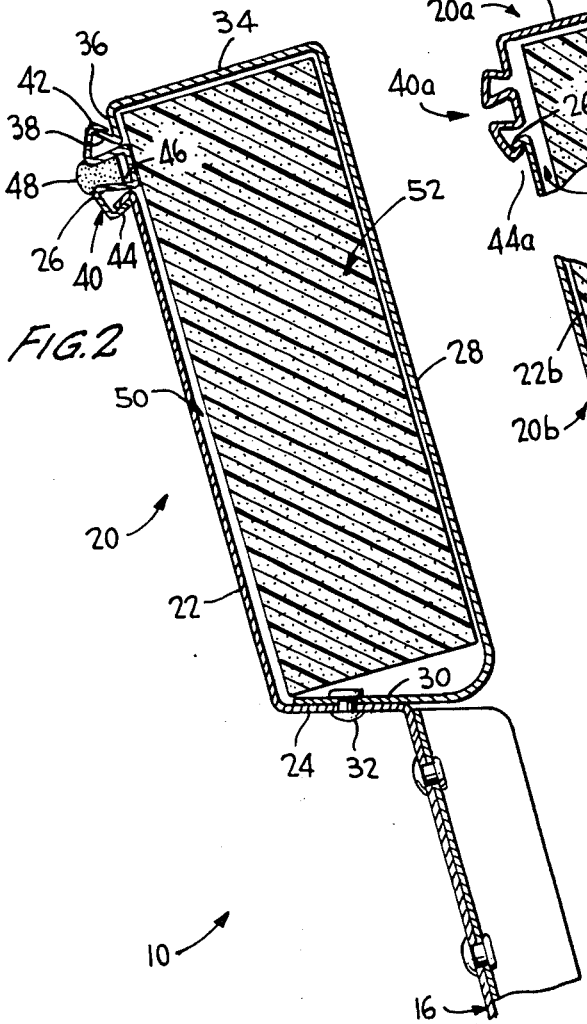
FIG. 2
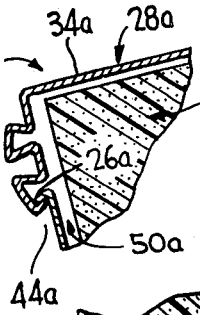
FIG. 3
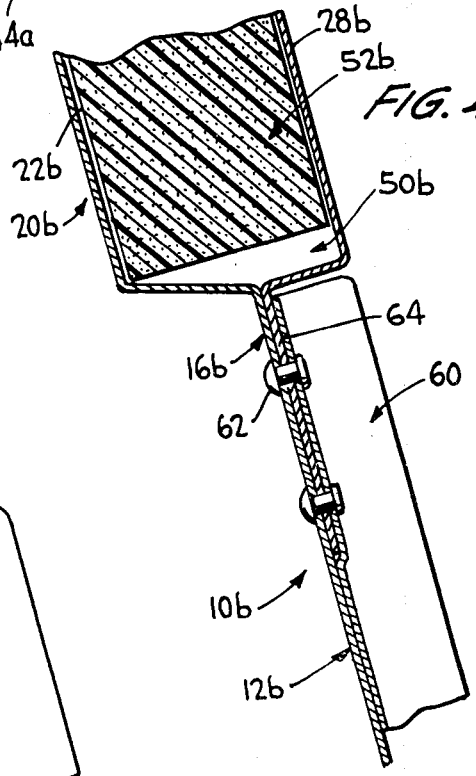
FIG. 4

BOAT CONSTRUCTION INCORPORATING FLOTATION MEANS

This application is a continuation-in-part of application Ser. No. 682,636 filed May 3, 1976.

This invention relates to a boat construction and relates more particularly to the provision of a flotation chamber in the form of a sponson means at least along portions of the gunwale.

It is particularly important with small boats to provide flotation means in the event that the boat is capsized. Many suggestions have been made heretofore for incorporating flotation means into such small boats, but such prior art designs have either not been effective, or are relatively expensive to manufacture. Moreover, many prior art arrangements have not been particularly aesthetic.

Although the instant inventive concepts are primarily related to small recreation type boats such as flat-bottomed row boats, canoes or small fishing boats ordinarily formed primarily of aluminum, it is to be understood that this invention is not limited to use in boats of that nature, but will be equally applicable to any size boat, regardless of the material of manufacture. However, since the provision of a flotation chamber according to this invention is particularly useful in small aluminum recreation boats or the like, the remainder of the instant disclosure will be directed to such preferred embodiment.

It is a primary object of this invention to provide a boat with a flotation means along at least a portion of each side of the hull in the form of a sponson which defines a chamber carrying a flotation material therewithin. Again, although a preferred flotation material is expanded polystyrene, other flotation materials, either formed separately or in situ, can be utilized without departing from the instant invention.

A basic object of this invention is the provision of a sponson means at the gunwale of a boat, a portion of which is formed integrally with the boat hull and a further portion of which is secured to the boat hull at the gunwale, with the two portions being resiliently held together to define an enclosed chamber which receives the flotation material.

A further object of this invention is the provision of a sponson means of the type described wherein the connection of the two elements forming the chamber is readily accomplished without the need for tools or the like.

Yet another object of this invention is the provision a flotation chamber at the gunwale of a boat which is aesthetically pleasing and which integrally defines a rub rail or a means for carrying a rub rail to protect the boat against damage when it engages a dock or the like.

Still further object of this invention is the provision of flotation means on a small recreation type boat or the like which is simple and inexpensive to manufacture, easy to assemble and maintain, and attractive in appearance.

Still other objects will in part be obvious and in part be pointed out as the description of the invention proceeds with reference to the accompanying drawings wherein:

FIG. 1 is a fragmentary transverse cross-sectional view through a boat incorporating flotation means according to the instant inventive concepts;

FIG. 2 is an enlarged cross-sectional view through one embodiment of a sponson means according to this invention;

FIG. 3 is a fragmentary cross-sectional view through a modified embodiment;

FIG. 4 is a fragmentary cross-sectional view through still a further modification of the instant inventive concepts;

Like reference numerals referred to like parts throughout the several views of the drawings.

Figure 5:
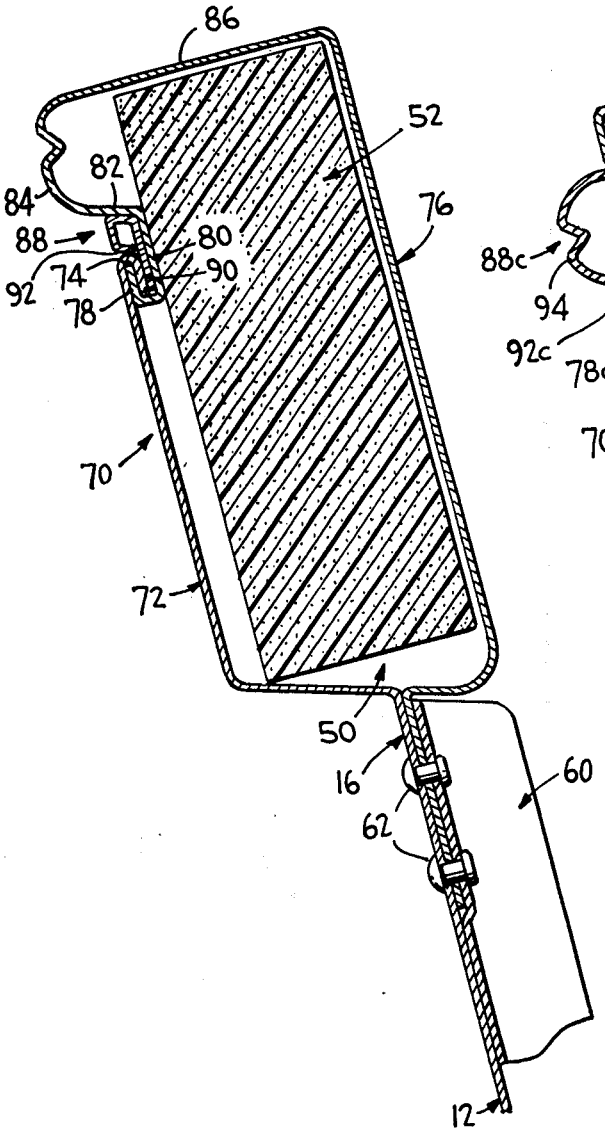
FIG. 5 is a view similar to FIG. 2 of yet another embodiment of sponson means according to this invention.

Referring now to the drawings in general, and more particularly to FIG. 1, a transverse cross-section is shown of a small recreational flat-bottomed boat designated generally by the reference numeral 10. Again, as pointed out above, this embodiment is shown merely as illustrative and the boat could have any of a variety of shapes and sizes without departing from the instant inventive concepts. Moreover, although the boat is preferably formed of aluminum, boats of other materials may incorporate the flotation chamber of this invention as well.

The boat 10 has a hull means 12 including a bottom portion 14 and upstanding wall portions 16. Of course, the boat has a bow, a stern and longitudinally extending, laterally spaced sides. The upstanding wall portions 16 terminate in a gunwale, along at least a portion of which is defined sponson means 18 according to this invention. Although the sponson means 18 may be provided around the entire periphery of the boat 10, according to the preferred embodiment, sponson means are defined only along the side portions of the boat 10.

One embodiment of sponson means according to this invention is designated generally by the reference numeral 20 in FIG. 2 and comprises basically a first upwardly extending member 22 integrally connected through a lower inwardly directed flange 24 with the upstanding wall portion 16 of the hull means 12. The upper end portion of the first member 22 terminates in an outwardly and downwardly reverted first lip member 26. A second upwardly extending member or cover 28 has its major extent spaced inwardly of the first member 22 with its lower end portion defining an outwardly directed flange means 30 overlying the flanged portion 24 of the first member 22 and secured thereto as by rivets or the like 32. The upper end portion of the second member 28 defines an outwardly directed flange 34 which extends over the upper end portion of the first member 22. In the embodiment of FIG. 2 the flange 34 terminates in a downwardly extending portion 35 which defines an outwardly and upwardly reverted second lip member 38.

The lip members 36, 38 are secured to each other via a connecting means 40 which in the embodiment of FIG. 2 is defined by an odd-shaped roll form or extruded piece including an upper inwardly and downwardly reverted third lip member 42 engaged over the second lip member 38 and a lower inwardly and upwardly reverted fourth lip member 34 engaged under the first lip member 26 with a connecting portion therebetween. The element 40, due to its shape and the material from which it is formed, can be resilient to secure the lip members 26, 38 to each other or this element can be relatively rigid and resiliency can be supplied by the shape and material of the second member 28. The connecting means 40, in and of itself, can define a rub rail means or, alternatively, the connecting means 40 can define a pocket 46 in which an elastomeric rub rail means 48 can have portions secured, with further portions extending outwardly to engage a dock or the like and thereby protect the boat 10 from change.

The foregoing elements together define an enclosed flotation chamber 50 within which is carried flotation means 52 in the form of a block of expanded polystyrene or the like.

Reference is now made to the fragmentary showing in FIG. 3 of a modified design for connecting the first and second members, parts of this embodiment similar to the embodiment of FIG. 2 being designated by the same reference numeral followed by the suffix "*a*" for ease in understanding. In this embodiment the connecting means **40*a* is integrally formed with the second member 28*a* so that the lip member 44*a* resiliently engages under the lip member 26*a* to close the flotation chamber 50*a***.

In FIG. 4 a fragmentary view is shown of a modified arrangement for securing the second member to the hull of the boat, parts similar to the embodiment of FIG. 2 being designated by the same reference numeral followed by the suffix "*b*". It is conventional in small boats of this type to include a plurality of laterally extending, longitudinally spaced, strengthening rib means spanning the bottom and upstanding wall portions of the hull means, one such rib means being designated by the reference numeral 60. These rib means are normally attached to the upstanding wall portion of the hull means by rivets 62 which, in the embodiment of FIG. 4, pass simultaneously through the upstanding wall portions **16*b* of the hull means 12*b*, flanges on the strengthening rib means 60 and a further downwardly extending flange 64 on the lower end portion of the second member 28*b***.

Of course, the manner in which the second member is connected to the hull means may either take the form shown in FIG. 2 or the form shown in FIG. 4, regardless of which embodiment of connecting means between these first and second members is utilized, i.e., the embodiment shown in FIG. 2, FIG. 3, or FIGS. 5 to 9. The preferred combination at the present time is the arrangement shown in FIG. 4 for connecting the bottom end portion of the second member **28*b* to the upstanding wall portions 16*b* of the hull means 12*b* with a connecting means of the type shown in FIG. 2 at 40 between the first and second members 22, 28**.

Reference is now made particularly to FIG. 5 wherein a further modified sponson means is designated generally by the reference numeral 70. In this embodiment, the first member 72 defines an inwardly and downwardly reverted lip member 74 at its upper end. The second member 76 includes an outwardly and upwardly reverted second lip member 78 engaged under the first lip member 74 and defining a pocket between the lip member 78 and a downwardly directed portion 80. Spaced above the interengagement between the lip members 74, 78 is an outwardly directed portion 82 of the second member 76 and a resilient means 84 interconnecting said outwardly directed portion 82 and the outwardly directed flange 86 of the second member 76. This resilient means 84 can simultaneously function as a rub rail means. In this embodiment a connecting means 88 comprises a downwardly directed end portion 90 engaged in the pocket between these second lip member 78 and the downwardly directed portion 80 of the second member 76, the opposite end portion 92 of the connecting means 88 pressing the first and second lip members 74, 78 into engagement with each other.

Figure 6:
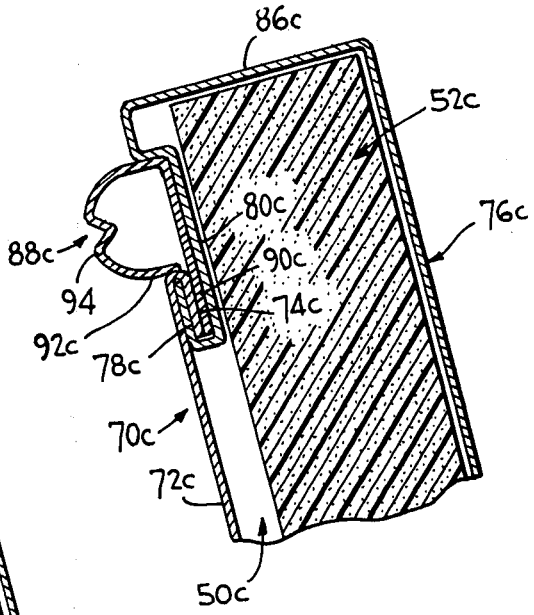
FIG. 6 is a fragmentary cross-sectional view through yet another embodiment of the instant inventive concepts.

The embodiment of FIG. 6 is similar in some respects to the embodiment of FIG. 5 and carries the same reference numerals for like parts followed by the suffix "*c*". The basic difference between the embodiment of FIG. 6 and the embodiment of FIG. 5 is that the resilient means which can also function as the rub rail means, is formed as a portion of the connecting means **88*c* as shown at 94 in the FIG. 6 embodiment rather than as a portion of the second member 76 as in the FIG. 5** embodiment.

Figure 7:
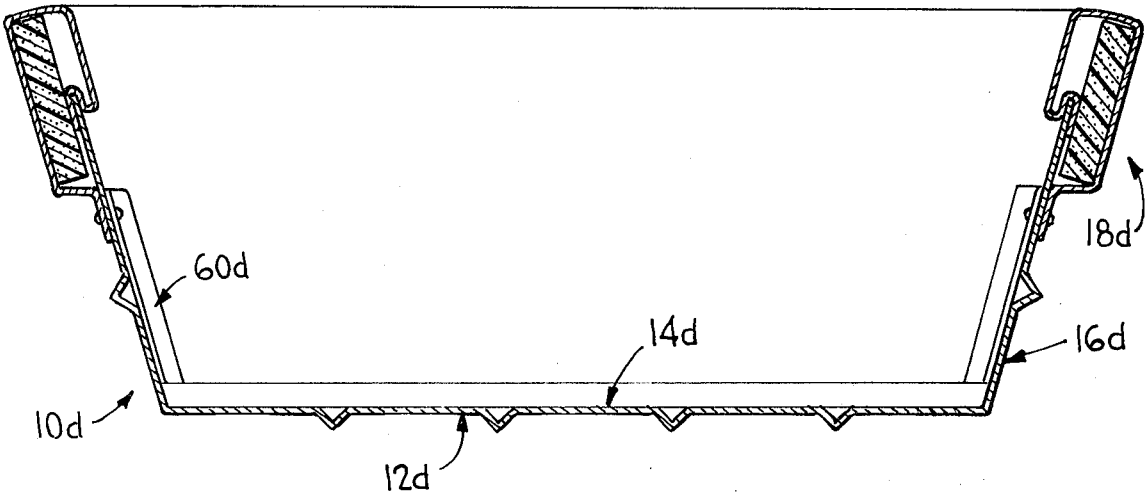
FIG. 7 is a view similar to FIG. 1 showing the incorporation of a still further modified embodiment of the instant inventive concepts.
Figure 8:
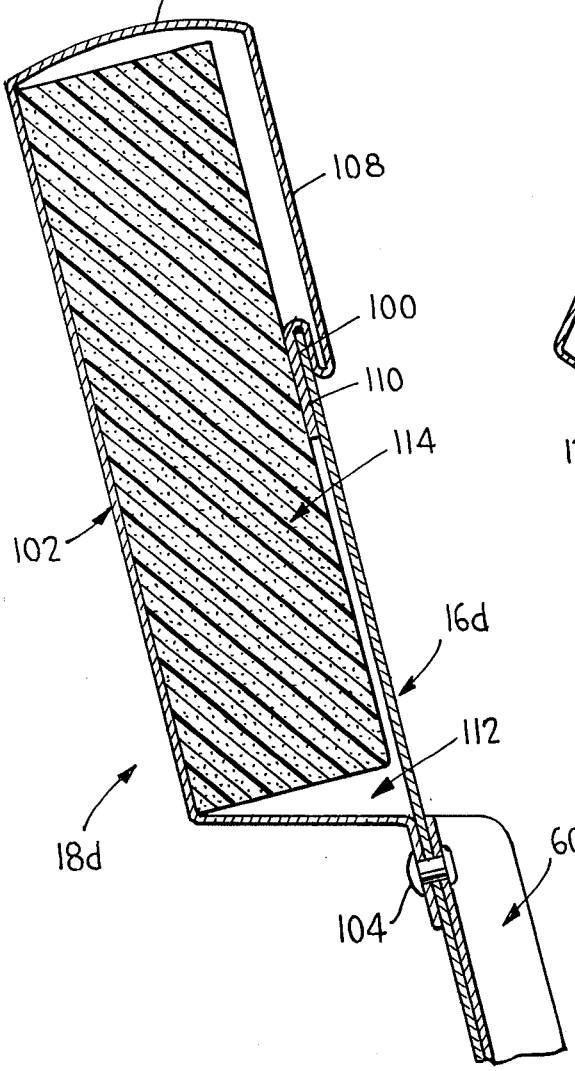
FIG. 8 is an enlarged cross-sectional view through the sponson means shown in the embodiment of FIG. 7.

Reference is now made to FIGS. 7 and 8 for a further modified embodiment of the instant inventive concepts. In FIG. 7, a view similar to the view of FIG. 1 is shown and like parts are designated by the same reference numerals followed by the suffix "*d*" for simplicity. The details of the sponson means **18*d* are shown enlarged in FIG. 8 from which it will be seen that the upstanding wall portions 16*d* in this embodiment terminate in an upper end portion 100 so that the first member is integral with the hull means 12*d* and is inwardly of the major extent of the cover or second member 102. The lower end portion of the second member 102 is connected as by means of rivets or the like 104 to the side wall portions 16*d* and the strengthening rib member 60*d* if such a rib member is utilized. The second member 102 has an inwardly directed upper end portion 106 which turns downwardly at 108 to form a reverted S-shaped second member lip means 110 which is resiliently engaged over and against the upper end portion 100 of the first member to define a flotation chamber 112 within which is maintained a block of flotation material 114. If desired, an integral outwardly extending rub rail means (not shown) such as is utilized in the embodiment of FIG. 9**, can be incorporated in this embodiment as well.

Figure 9:
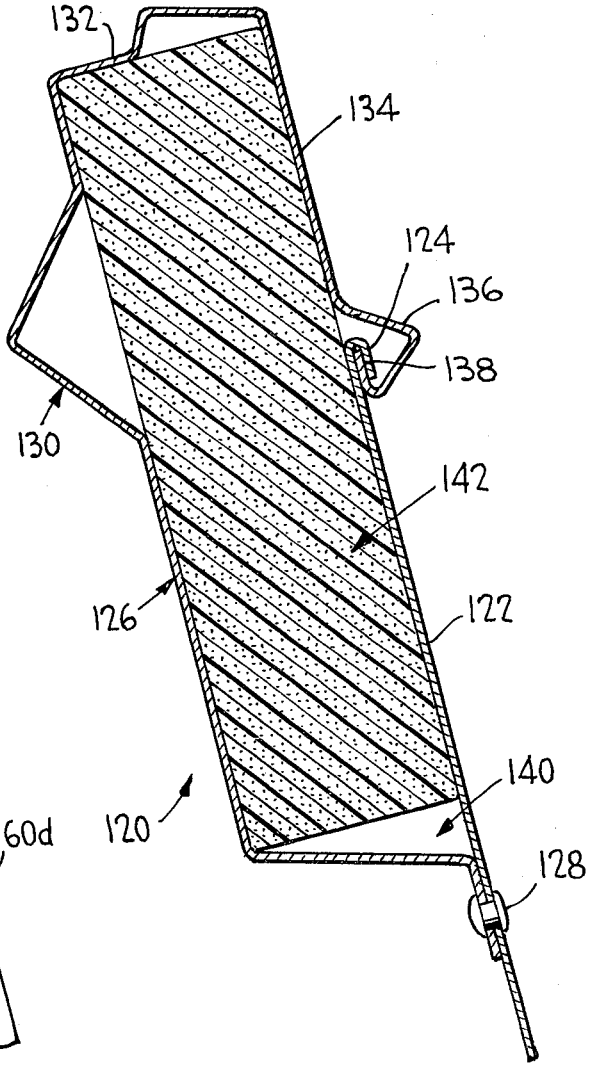
FIG. 9 is a fragmentary cross-sectional view through yet another modified embodiment.

In the embodiment of FIG. 9, a still further modification of sponson means according to the instant inventive concepts is designated generally by the reference numeral 120. In this embodiment, as in the embodiment of FIG. 8, the first member 122 is integral with the side wall portions of the hull and terminates in a reverted first member lip means 124. The second member or cover 126 has its major extent spaced outwardly of the first member 122 and is secured as by rivets or the like 128 at its lower end portion to the side wall of the hull means. This embodiment incorporates an integral resilient portion 130 which functions as a rub rail means, an inwardly directed upper end portion 132 turning downwardly at 134 and formed into a triangular element 136 terminating in an upwardly extending second member lip means 138 engaged under the first member lip means 124 to define the enclosed flotation chamber 140 within which is maintained the flotation means 142.

It will be seen that each of the embodiments shown in FIGS. 2, 3, 5, 6 and 9 for securing the first and second members to each other incorporate first and second lip means and connecting means resiliently engaging the first and second lip means with each other to secure the flotation means within the flotation chamber. In certain of these embodiments, the resiliency is provided by the second member and in other of these embodiments the resiliency is provided by a separate connecting member. In the embodiment of FIGS. 7 and 8 the first member does not actually include a lip means, but the upper end portion thereof is engaged by the lip means of the second member which provides the resiliency to interconnect the first and second members and define the flotation chamber.

In all of the embodiments, the flotation means can be secured within the flotation chamber by connecting the second member at its lower end to a portion of the upstanding wall of the hull and resiliently locking the first and second members to each other.

Each embodiment can further provide in one form or another a resilient rub rail means to protect the boat from damage and an overall arrangement that is readily assembled and aesthetically quite pleasing.

Thus, it will now be seen that there is herein provided an improved boat construction having sponson means defined along at least a portion of its gunwale in a manner which satisfies all of the objectives of the instant inventive concepts as set forth hereinabove, and others, including many advantages of great practical utility and commercial importance.

The embodiments of the invention in which an exclusive property or privilege is claimed are defined as follows:

1. A boat comprising a hull means including a bottom portion and upstanding wall portions, said hull means having an inner surface, an outer surface, longitudinally extending, laterally spaced sides, sponson means along at least a portion of each side of said hull means, said sponson means including upper and lower ends, inner and outer portions and defining an enclosed flotation chamber, flotation means carried within said flotation chamber, said sponson means being defined by a first upwardly extending member having upper and lower end portions, a second upwardly extending member having upper and lower end portions, the major extent of said second member being spaced laterally from the major extent of said first member, and a laterally directed flange at said upper end portion of said second member extending over said upper end portion of said first member, said upper end portion of said second member terminating in a second member lip means, and connecting means resiliently engaging said upper end portion of said first member with said second member lip means to secure said flotation means within said flotation chamber, said upper end portion of said first member terminating in a first member lip means including an outwardly and downwardly reverted first lip member, said second member including an inwardly and downwardly extending end portion terminating in an upwardly extending second lip member engaged under said first lip member, and said connecting means being defined by the resilience of said second member, said resilience being independent of the flotation means, and said resilience normally biasing said second lip member into securing engagement with said first lip member for maintaining said flotation means within said flotation chamber.

2. The boat of claim 1 wherein said flotation means is expanded polystyrene.

3. The boat of claim 1 wherein one of said members is integral with said hull means.

4. The boat of claim 3 wherein said first member is integral with said upwardly extending wall portions of said hull means at its lower end portion.

5. The boat of claim 3 further including securing means connecting said lower end portion of the other of said members to said hull means.

* * * * *